US010068503B2

(12) United States Patent
Zhang et al.

(10) Patent No.: US 10,068,503 B2
(45) Date of Patent: Sep. 4, 2018

(54) BACKLIT TENSION FABRIC POPUP DISPLAY

(71) Applicant: Hangzhou Bannermate Exhibition System Co., Ltd., Hangzhou (CN)

(72) Inventors: Hankai Zhang, Hangzhou (CN); Zhen Yang, Hangzhou (CN)

(73) Assignee: Hangzhou Bannermate Exhibition System Co., Ltd., Hangzhou (CN)

( * ) Notice: Subject to any disclaimer, the term of this patent is extended or adjusted under 35 U.S.C. 154(b) by 0 days.

(21) Appl. No.: 15/239,826

(22) Filed: Aug. 18, 2016

(65) Prior Publication Data

US 2017/0330493 A1 Nov. 16, 2017

(30) Foreign Application Priority Data

May 16, 2016 (CN) ..... 2016 1 0321667

(51) Int. Cl.

| | |
|---|---|
| ***G09F 13/00*** | (2006.01) |
| ***G09F 13/22*** | (2006.01) |
| ***F21V 21/08*** | (2006.01) |
| ***F21V 23/06*** | (2006.01) |
| ***G09F 15/00*** | (2006.01) |
| *F21Y 115/10* | (2016.01) |
| *F21Y 103/10* | (2016.01) |
| *G09F 7/18* | (2006.01) |

(52) U.S. Cl.

CPC ..... *G09F 13/22* (2013.01); *F21V 21/08* (2013.01); *F21V 23/06* (2013.01); *G09F 15/00* (2013.01); *F21Y 2103/10* (2016.08); *F21Y 2115/10* (2016.08); *G09F 2007/1886* (2013.01); *G09F 2013/222* (2013.01); *G09F 2015/0093* (2013.01)

(58) Field of Classification Search

USPC ..... 40/549

See application file for complete search history.

(56) References Cited

U.S. PATENT DOCUMENTS

| | | | | |
|---|---|---|---|---|
| 2,911,179 | A * | 11/1959 | Hammerly | H02G 5/06 248/339 |
| 5,900,850 | A * | 5/1999 | Bailey | G09F 9/33 340/815.83 |
| 6,250,039 | B1 * | 6/2001 | Karten | G09F 15/0068 40/610 |
| 6,829,869 | B1 * | 12/2004 | Savoie | G09F 15/0068 135/122 |

(Continued)

*Primary Examiner* — Kristina N S Junge

(74) *Attorney, Agent, or Firm* — Gokalp Bayramoglu

(57) ABSTRACT

The invention discloses a backlit tension fabric popup display, including an exhibit grid frame, backlit grooved straight rods and a plurality of roller-shutter-style LED light bars. A plurality of roller-shutter-style LED light bars are suspended on the light bar hooks between the upper and lower X-shaped pull rods. Four sides on one plane or eight sides on two planes of the exhibit grid frame are all connected to the backlit grooved straight rods by the corner grooved plastic parts at both ends. A display is formed by inserting the silicone strips at the edges of the display into the corresponding grooves of the backlit grooved straight rods. The backlit tension fabric popup display and the LED light bars are perfectly combined, without the black rim, folds or a light leak. In addition, single or double planes are chosen as needed.

20 Claims, 13 Drawing Sheets

(56) References Cited

U.S. PATENT DOCUMENTS

| | | | | |
|---|---|---|---|---|
| 7,107,733 | B1 * | 9/2006 | Rueckert | E04B 1/3441 135/122 |
| 8,312,653 | B2 * | 11/2012 | Fritsche | G09F 15/0062 160/135 |
| 8,599,104 | B2 * | 12/2013 | Gardner | F21S 2/005 345/1.1 |
| 8,640,369 | B2 * | 2/2014 | Dysart | G09F 9/33 362/217.15 |
| 9,449,538 | B2 * | 9/2016 | Davis | G09F 9/33 |
| 2014/0027597 | A1 * | 1/2014 | Farris | F16B 7/105 248/339 |
| 2015/0143729 | A1 * | 5/2015 | Pyc | G09F 15/0012 40/607.1 |

* cited by examiner

BACKLIT TENSION FABRIC POPUP DISPLAY

CROSS REFERENCE TO RELATED PATENT APPLICATION

This application claims the priority of the Chinese patent application No. CN201610321667.0, filed on May 16, 2016. The contents of the above application are incorporated by reference in their entirety.

TECHNICAL FIELD

The invention relates to display equipment field, and particularly relates to a backlit tension fabric popup display.

BACKGROUND

With the rapid developments of the economy, various commercial advertising campaigns increase day by day. As an important aid for promoting corporate images, advertising exhibition display equipment is increasingly applied in various commercial fields such as shopping mall promotions, product promotions, exhibitions, press conferences, and outdoor propagandas. There is various advertising exhibition display equipment, wherein a popup display is a first choice for promoting products and using as a background due to simple assembly and portability.

In the prior art, when light effects are required for the exhibits or in other scenarios requiring lights, the lamp tubes are combined with an exhibit grid frame by drilling into the popup display, resulting in poor portability, complex installation and requiring professionals for installation. In addition, a high voltage is needed for the ordinary lamp tubes, creating a potential safety concern. Moreover, the combination of lamp tubes and the exhibit grid frame has inevitable problems of an uneven brightness, a black rim and a short service life.

SUMMARY OF THE INVENTION

The design objectives of this invention is to avoid the deficiencies of the prior arts and provide a backlit tension fabric popup display.

The invention provides the following technical solution:

A backlit tension fabric popup display includes an exhibit grid frame, backlit grooved straight rods and a plurality of roller-shutter-style LED light bars. The exhibit grid frame is composed of a plurality of X-shaped pull rods. The pull rods are connected to each other by plastic parts with nails. Link parts are located inside the exhibit grid frame. The link parts are fixed to two symmetrically arranged plastic parts with nails when exhibit grid frame is open. Corner grooved plastic parts engaged with backlit grooved straight rods are fixed to plastic parts with nails at each corner of exhibit grid frame. A plurality of roller-shutter-style LED light bars are suspended on the light bar hooks between the upper and lower X-shaped pull rods. Four sides on one plane of the exhibit grid frame are all connected to the backlit grooved straight rods by the corner grooved plastic parts at both ends. Alternatively, eight sides on two planes of the exhibit grid frame are all connected to the backlit grooved straight rods by the corner grooved plastic parts at both ends. A display is formed by inserting the silicone strips at the edges of the display into the corresponding grooves of the backlit grooved straight rods.

Further, the backlit grooved straight rod is composed of a plurality of backlit straight rods. The backlit straight rod is a right triangular straight rod. Two grooves vertical with each other are provided on the non-right-angle side for either side of the right triangle except the hypotenuse. The adjacent backlit straight rods are connected to each other by inserting plastic pans.

Further, the non-right angle of the right triangular straight rod, without grooves, is 20 degrees –70 degrees. The non-right angle is sharp or blunt.

Further, a plurality of backlit straight rods are connected to each other in series by ox tendon, in case of difficulty in locating due to dispersion.

Further, end connectors for connecting to the corner grooved plastic parts are respectively provided at both ends of the backlit grooved straight rod.

Further, the light bar hook has a left hook and a right hook. The light bar hook includes a hook, an extended bar, a spring and a clamp. The clamp is a U-shaped clamp, composed of a first clamping piece, a second clamping piece and a clamping holder. A groove engaged with the LED light bar is provided between the first clamping piece and the second clamping piece. The lower end of the hook is connected to the upper end of the extended bar and the hook may be rotatable on the extended bar. The lower end of the extended bar is connected to the upper end of a spring, and the extended bar is inserted into the clamping holder of the clamp by the spring. The spring is fixed within the clamping holder of the clamp by a fastener at the bottom. The widths of the first clamping piece and the second clamping piece of the left hook are both increased towards the left, while the widths of the first clamping piece and the second clamping piece of the right hook are both increased towards the right.

Further, the hook, the extended bar and the clamp are all made of plastic.

Further, intra-columns of roller-shutter-style LED light bars are connected by the engaged DC male and female connectors, and each column of roller-shutter-style LED light bars is then connected to its own power adaptor. Alternatively, intra-columns of roller-shutter-style LED light bars are connected by the engaged DC male and female connectors, and the connected intra-columns of roller-shutter-style LED light bars are then connected to a single power adaptor.

The advantageous effects of the invention are illustrated as below:

1. The backlit tension fabric popup display of the invention includes a plurality of roller-shutter-style LED light bars, which are suspended on the light bar hooks between the upper and lower X-shaped pull rods. The four sides on one plane, or eight sides on two planes of the exhibit grid frame in the invention are all connected to the backlit grooved straight rods. A display is formed by inserting the silicone strips at the edges of the display into the grooves of the backlit grooved straight rods, to perfectly combine the backlit tension fabric popup display and LED light bars, without the black rim, folds or light leak. In addition, single or double planes can be chosen as needed.

2. The backlit tension fabric popup display of the invention includes a plurality of roller-shutter-style LED light bars, which are suspended on the light bar hooks between the upper and lower X-shaped pull rods. Intra-columns of roller-shutter-style LED light bars are connected by the engaged DC male and female connectors, and each column of roller-shutter-style LED light bars is then connected to its own power adaptor. Alternatively, intra-columns of roller-shutter-style LED light bars are connected by the engaged DC male and female connectors, and the connected intra-columns of roller-shutter-style LED light bars are then connected to a single power adaptor. The solution allows a quick installation, a stable and safe voltage, a long service life, soft lights, a low energy consumption, and an easy and quick replacement of light bars without the need for a professional.

3. The light bar hooks for suspending the roller-shutter-style LED light bars of the invention have left hooks and right hooks; both are rotatable and retractable. The widths of the first clamping piece and the second clamping piece of the left hook are both gradually increased towards the left while the widths of the first clamping piece and the second clamping piece of the right hook are both gradually increased towards the right. With a certain rotation, the plurality of roller-shutter-style LED light bars are kept at the same level, rendering an even brightness and a pleasure to the eyes. The light bars are inserted from the wide sides of the clamping pieces, and the hooks are hooked on the X-shaped pull bars, allowing a quick and easy installation without a professional.

4. For assembly in the invention, the exhibit grid frame is quickly opened first to make the backlit grooved straight rods and roller-shutter-style LED light bars quickly installed, and then a display is formed by inserting the silicone strips at the edges of the display into the corresponding grooves of the backlit grooved straight rods, allowing a quick installation without any tool or professional installer, an easy transportation and storage, an aesthetic appearance and suitability for any fashionable occasions.

DETAILED DESCRIPTION

The invention is further explained combined with embodiments and the accompanying drawings. The following embodiments are only intended for illustrative purpose, without limiting the implementing scope of the invention.

Figure 1:
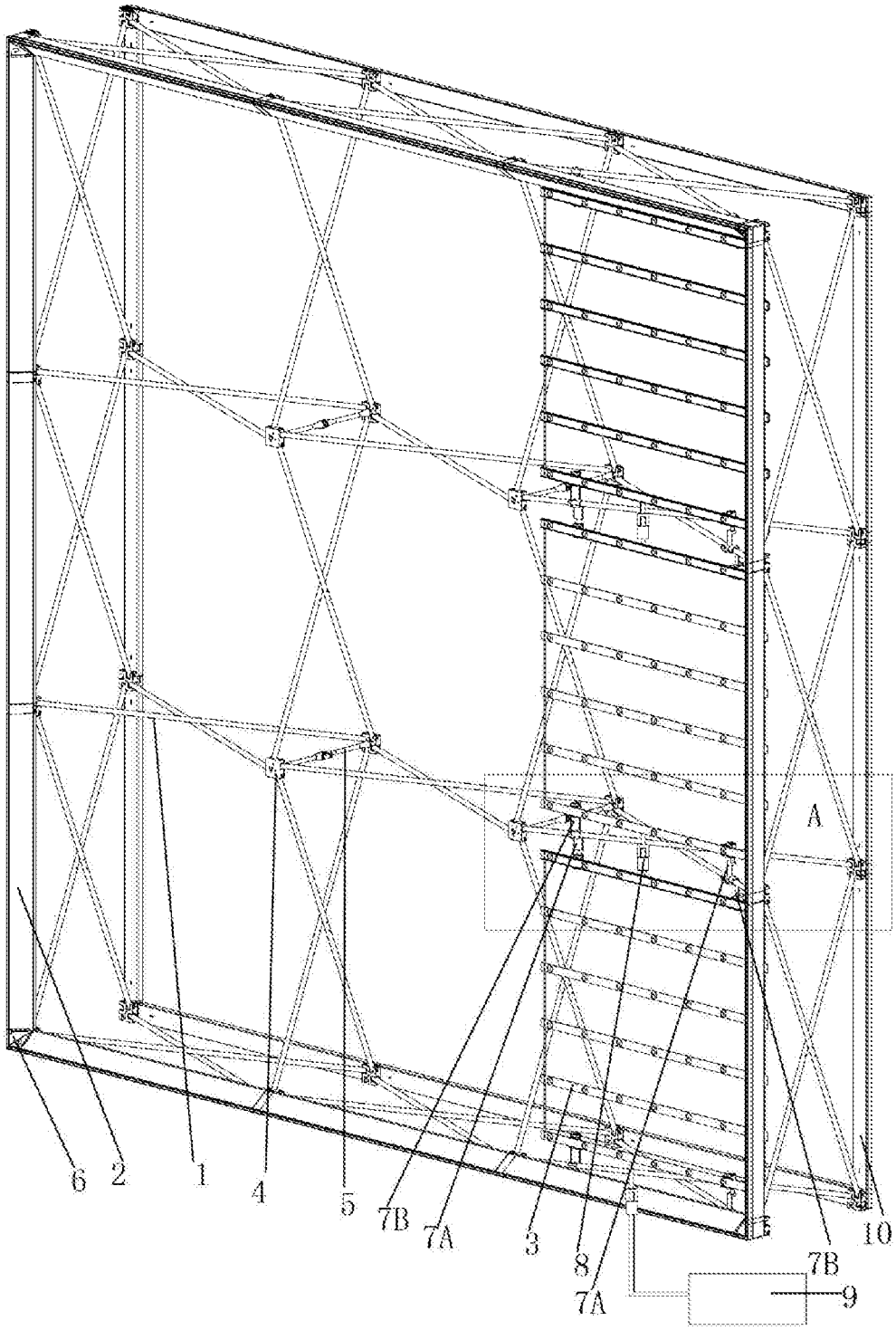
FIG. 1 is a structural schematic view of a popup display (single plane).
Figure 2:
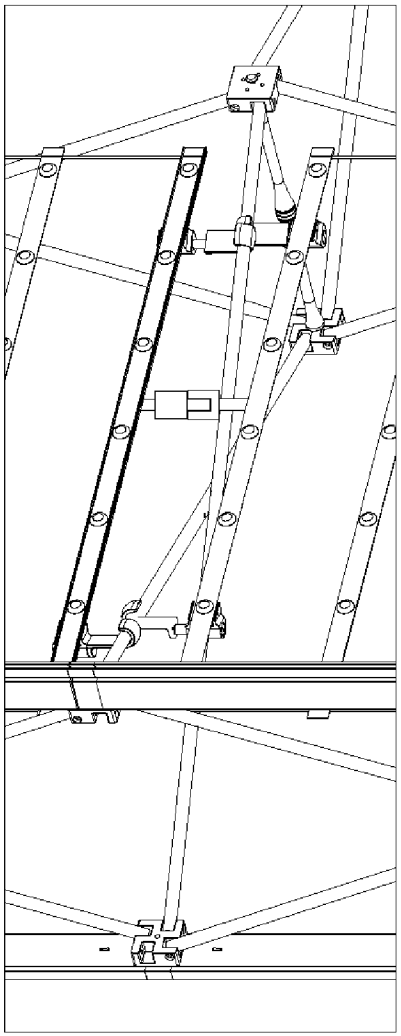
FIG. 2 is an enlarged schematic view at A in FIG. 1.
Figure 3:
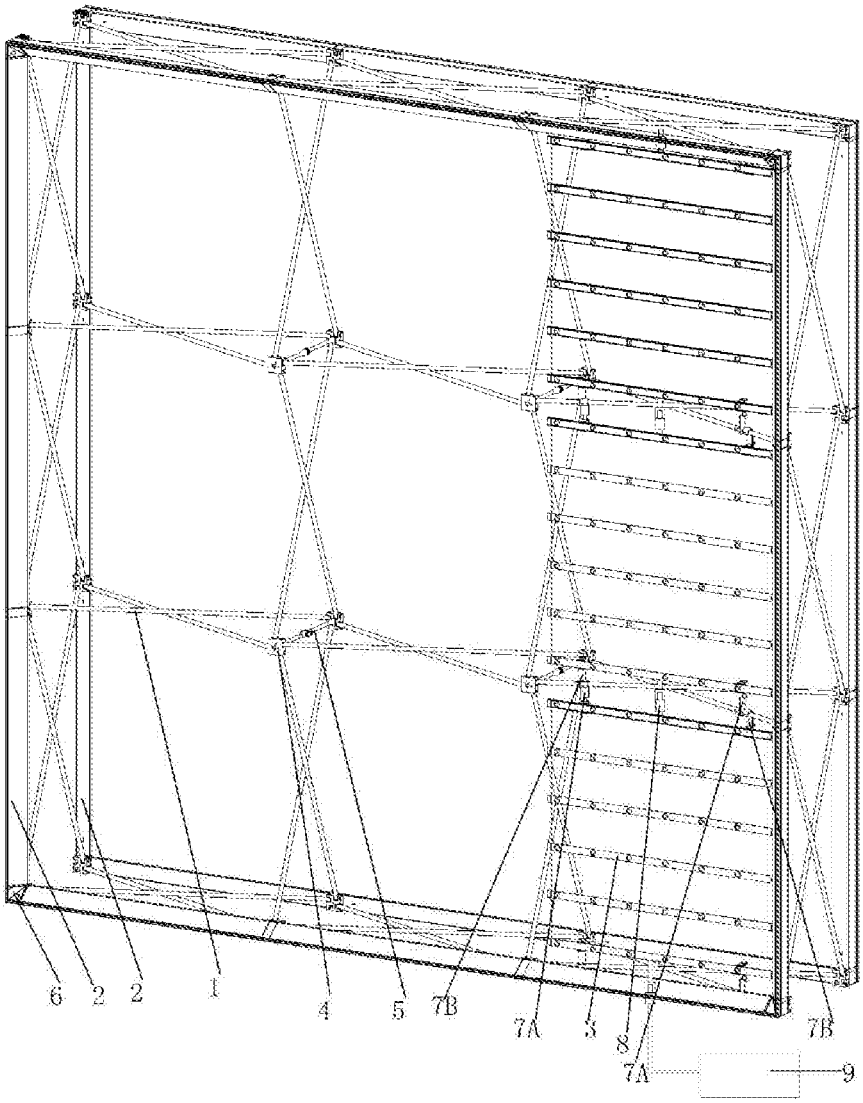
FIG. 3 is an another structural schematic view of a popup display (double planes).

A backlit tension fabric popup display as shown in FIGS. 1-3, includes exhibit grid frame 1, backlit grooved straight rods 2 and a plurality of roller-shutter-style LED light bars 3. Exhibit grid frame 1 is composed of a plurality of X-shaped pull rods. The pull rods are connected to each other by plastic parts 4 with nails. Link parts 5 are located inside the exhibit grid frame 1. Link parts 5 are fixed to two symmetrically arranged plastic parts 4 with nails when exhibit grid frame 1 is open. Corner grooved plastic parts 6 engaged with backlit grooved straight rods 2 are fixed to plastic parts 4 with nails at each corner of exhibit grid frame 1. A plurality of roller-shutter-style LED light bars 3 are suspended on the light bar hooks between the upper and lower X-shaped pull rods. Intra-columns of roller-shutter-style LED light bars 3 are connected by the engaged DC male and female connectors 8, and each column of roller-shutter-style LED light bar is then connected to its own power adaptor 9. Alternatively, intra-columns of roller-shutter-style LED light bars 3 are connected by the engaged DC male and female connectors 8, and the connected intra-columns of roller-shutter-style LED light bars 3 are then connected to a single power adaptor 9 (only one column in shown in FIGS. 1 and 3). Four sides on one plane of exhibit grid frame 1 are all connected to backlit grooved straight rods 2 by corer grooved plastic parts 6 at both ends, while the left and right sides on the other plane, or the upper, lower, left and right sides on the other plane are all connected to conventional straight rods 10. Alternatively, eight sides on two planes of exhibit grid frame 1 are all connected to backlit grooved straight rods 2 by corner grooved plastic parts 6 at both ends. A display is formed by inserting the silicone strips at the edges of the display into the corresponding grooves of backlit grooved straight rods 2, to perfectly combine the backlit tension fabric popup display and LED light bars, without the black rim, folds or a light leak. Moreover, single or double planes are chosen as needed. The backlit tension fabric popup display of the invention may be of any size and manufactured as required. Additionally, a plurality of backlit tension fabric popup displays may be combined as needed, to be used more widely.

Figure 4:
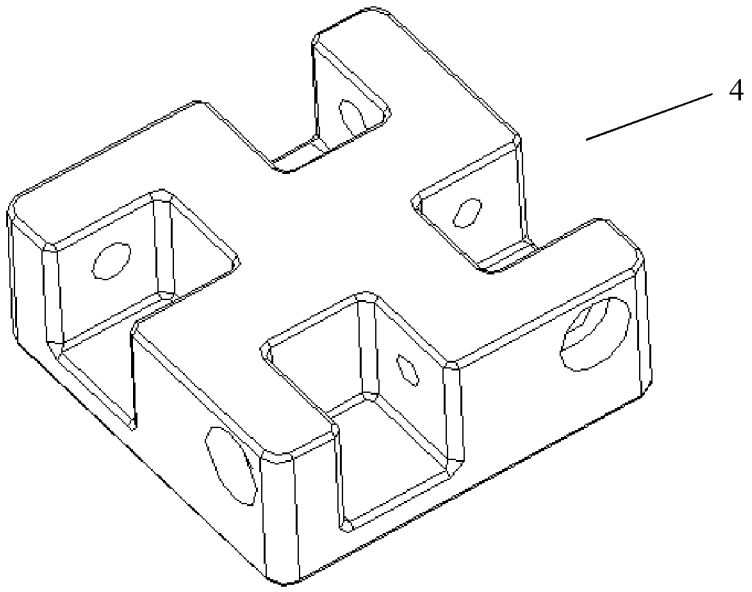
FIG. 4 is a structural schematic view of a plastic part with a nail of the grid frame.
Figure 5:
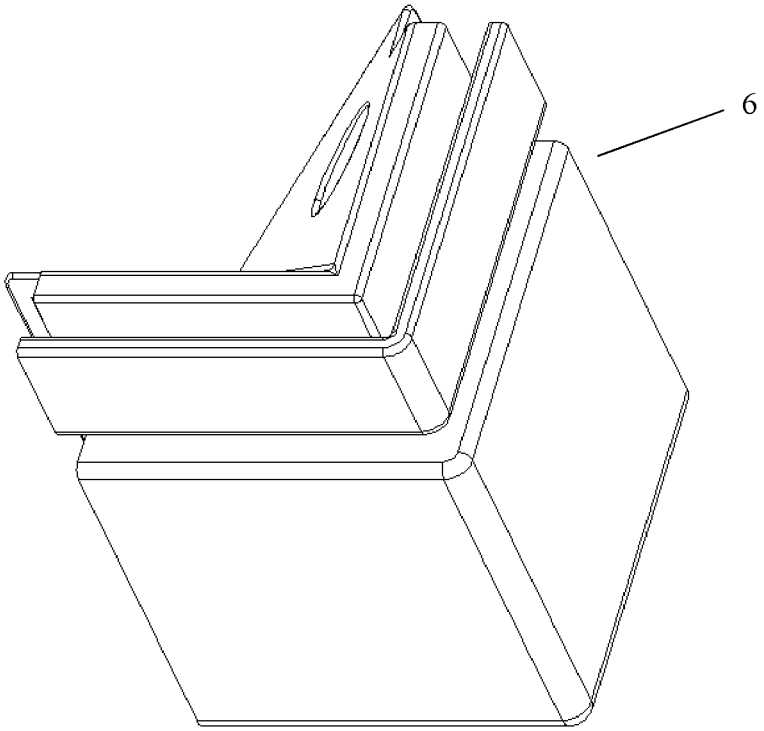
FIG. 5 is a structural schematic view of a corner grooved plastic part of the grid frame.

The structures of plastic parts 4 with nails and corner grooved plastic parts 6 are respectively shown in FIGS. 4 and 5.

Figure 6:
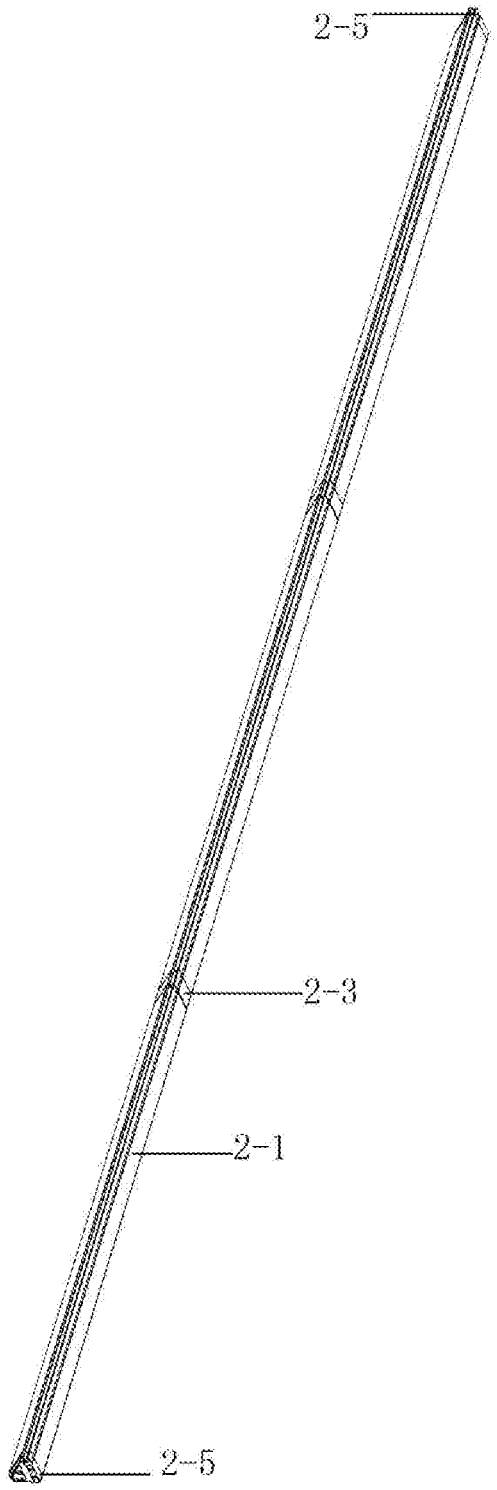
FIG. 6 is a structural schematic view of a backlit grooved straight rod.
Figure 7:
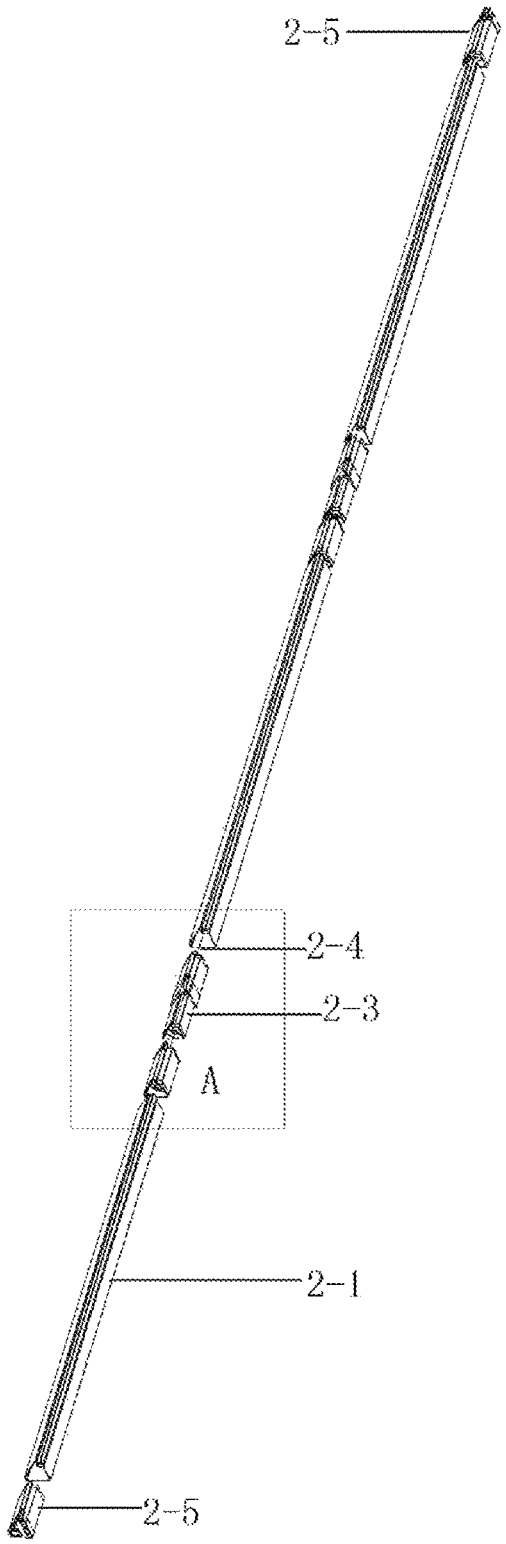
FIG. 7 is an explosive structural schematic view of a backlit grooved straight rod.
Figure 8:
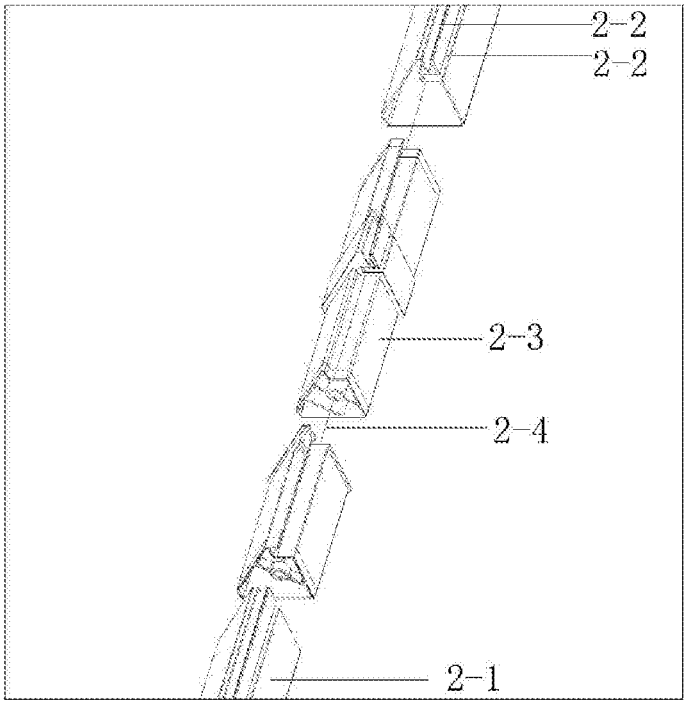
FIG. 8 is an enlarged schematic view at A in FIG. 7.
Figure 9:
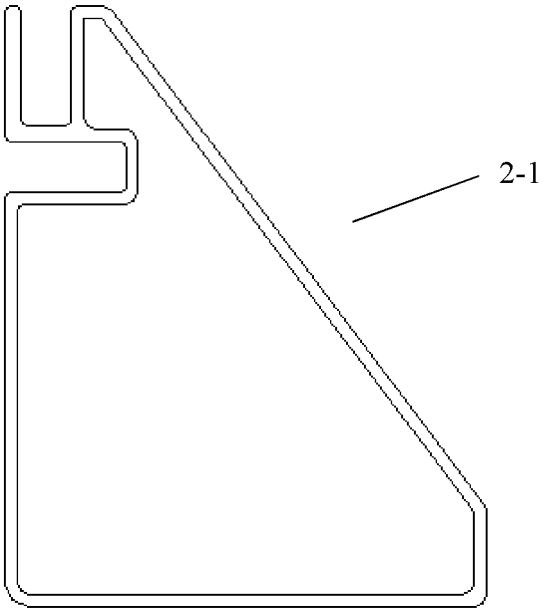
FIG. 9 is a cross-sectional schematic view of a backlit straight rod (blunt).
Figure 10:
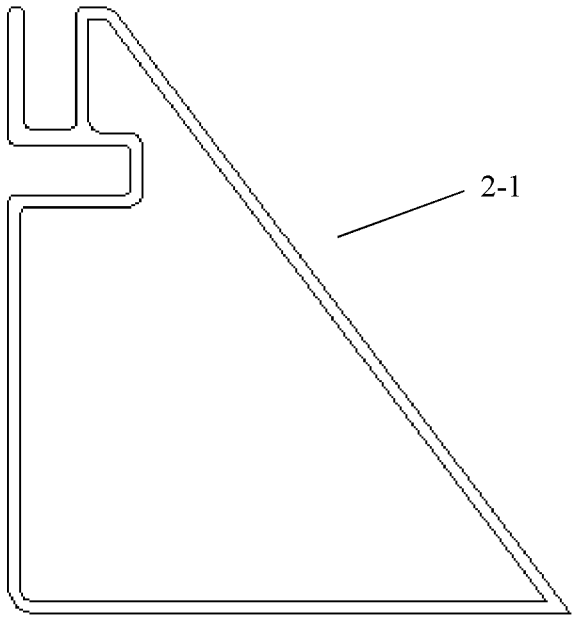
FIG. 10 is an another cross-sectional schematic view of the backlit straight rod (sharp).
Figure 11:
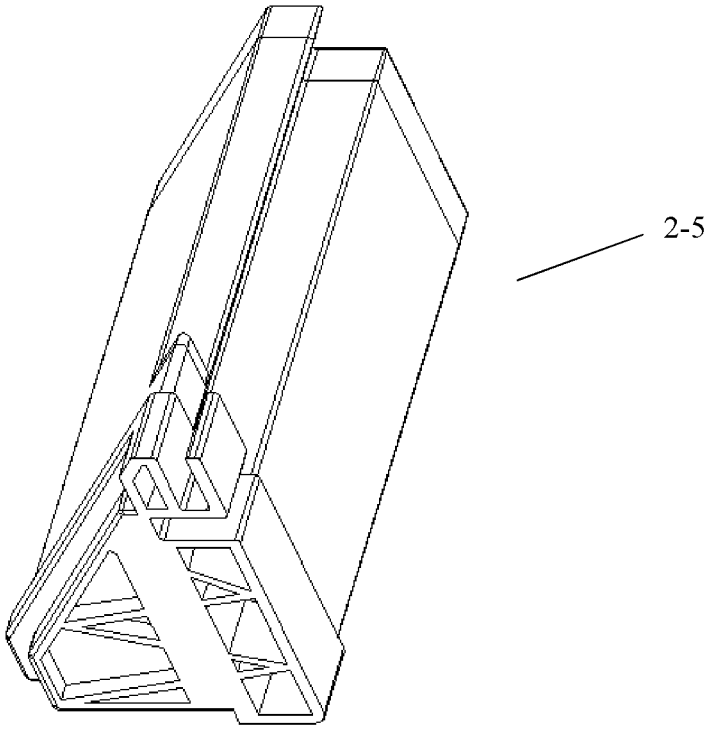
FIG. 11 is a structural schematic view of an end connector.
Figure 12:
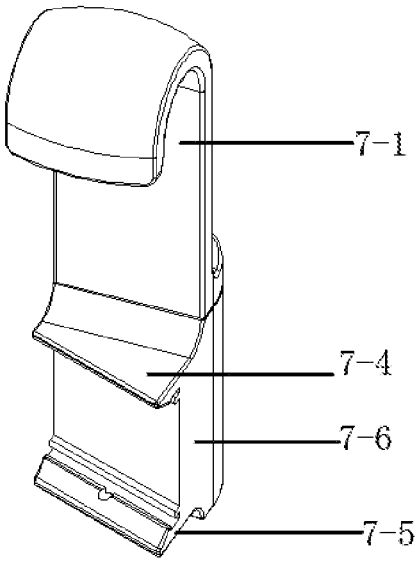
FIG. 12 is a state structural schematic view of a right hook.
Figure 13:
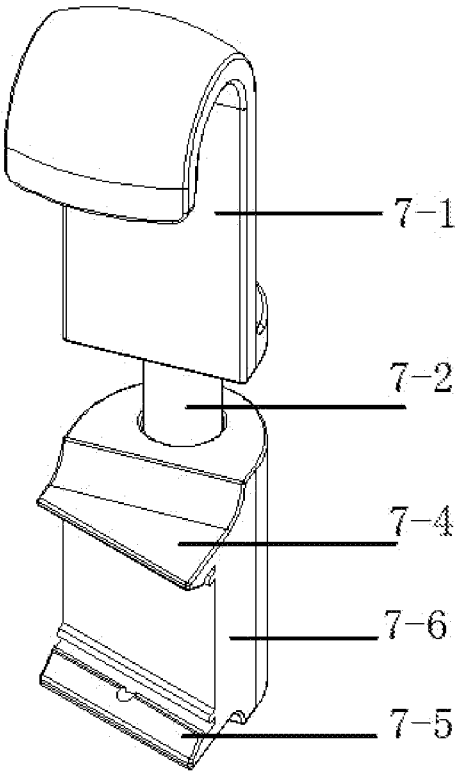
FIG. 13 is an another state structural schematic view of the right hook.
Figure 14:
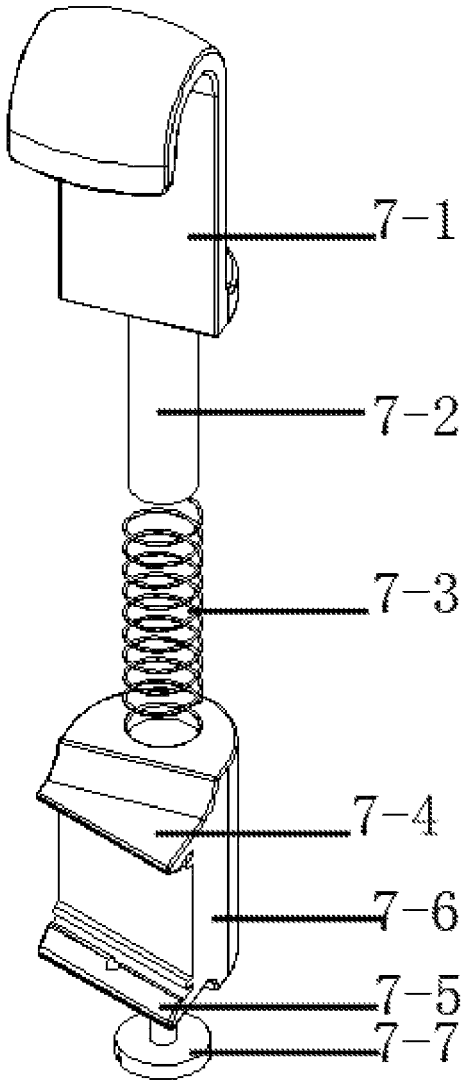
FIG. 14 is an explosive structural schematic view of the right hook.
Figure 15:
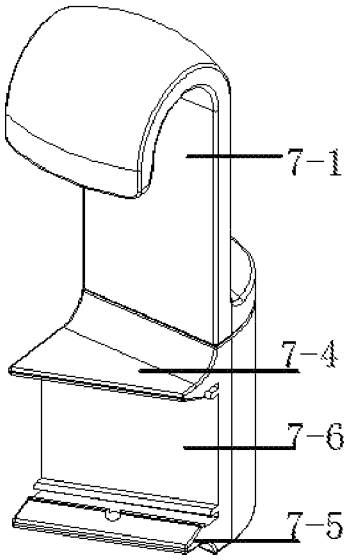
FIG. 15 is a state structural schematic view of a left hook.
Figure 16:
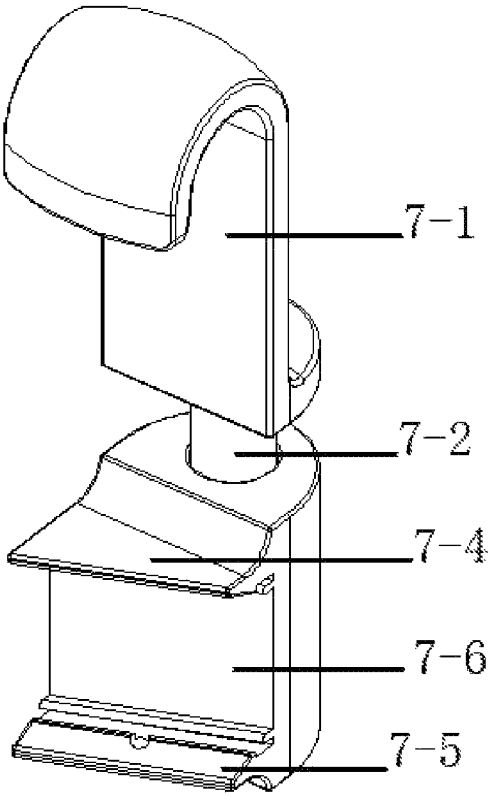
FIG. 16 is an another state structural schematic view of the left hook.
Figure 17:
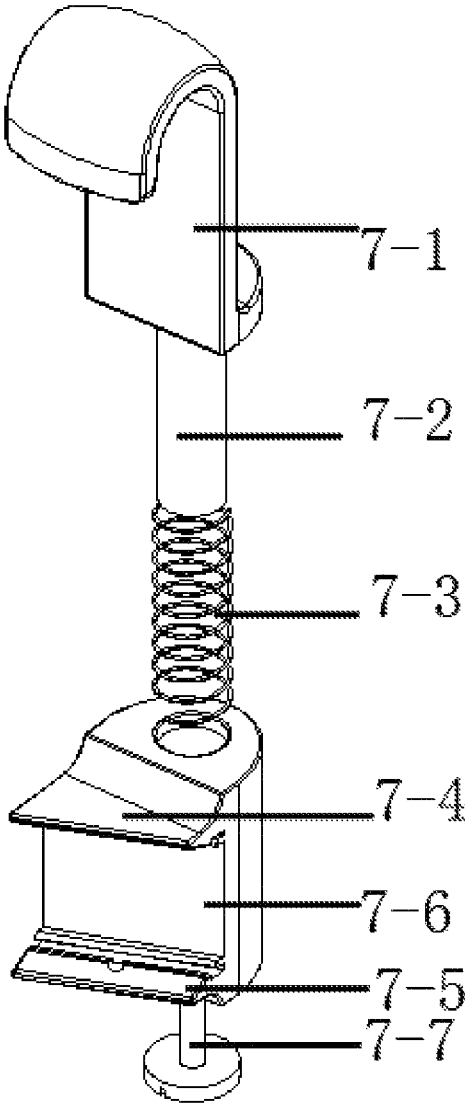
FIG. 17 is an explosive structural schematic view of the left hook.

As shown is FIGS. 6-8, backlit grooved straight rod 2 is composed of a plurality of backlit straight rods 2-1. Backlit straight rod 2-1 is a right triangular straight rod. Two grooves 2-2 vertical with each other are provided on the non-right-angle side for either side of the right triangle except the hypotenuse. As shown in FIGS. 9 and 10, the non-right angle of the right triangular straight rod, without grooves, is 20 degrees ~70 degrees. The non-right angle is sharp or blunt. The adjacent backlit straight rods 2-1 are connected to each other by inserting plastic parts 2-3. A plurality of backlit straight rods 2-1 is connected to each other in series by ox tendon 2-4, in case of difficulty in locating due to dispersion. End connectors 2-5 for connecting to corner grooved plastic parts 6 are respectively provided at both ends of backlit grooved straight rods 2. The structure of the end connector 2-5 is shown in FIG. 1.

As shown in FIGS. 12-17, the light bar hook has a left hook 7B and a right hook 7A. The light bar hook includes hook 7-1, extended bar 7-2, spring 7-3 and a clamp. The clamp is a U-shaped clamp, composed of first clamping piece 7-4, second clamping piece 7-5 and clamping holder 7-6. A groove engaged with the LED light bar is provided between first clamping piece 7-4 and second clamping piece 7-5. The lower end of hook 7-1 is connected to the upper end of the extended bar 7-2 and hook 7-1 may be rotatable on extended bar 7-2. The lower end of extended bar 7-2 is connected to the upper end of spring 7-3, and extended bar 7-2 is inserted into clamping holder 7-6 of the clamp by spring 7-3. Spring 7-3 is fixed within clamping holder 7-6 of the clamp by fastener 7-7 at the bottom. The widths of first clamping piece 7-4 and second clamping piece 7-5 of the left hook are both increased towards the left, while the widths of first clamping piece 7-4 and second clamping piece 7-5 of the right hook are both increased towards the right. Hook 7-1, extended bar 7-2 and the clamp are all made of plastic, so that the LED light bars are suspended with a low cost and a light weight. Both one left hook and one right hook are required for upper and lower ends of one roller-shutter-style LED light bar 3. When suspending, the light bar is inserted from the wide sides of the clamping pieces, and hook 7-1 is hooked on the X-shaped pull bars. With a certain rotation, the plurality of roller-shutter-style LED light bars 3 are kept at the same level, rendering an even brightness and a pleasure to the eyes.

For assembly in the invention, first, quickly open exhibit grid frame 1, quickly install backlit grooved straight rods 2 and roller-shutter-style LED light bars 3, and then the display is formed by inserting the silicone strips at the edges of the display into the corresponding grooves of grooved straight rods 2, allowing a quick installation without any tool or professional installer, an easy transportation and storage, an aesthetic appearance and suitability for any fashionable occasions.

What is claimed is:

1. A backlit tension fabric popup display, comprising:
an exhibit grid frame;
a plurality of backlit grooved straight rods; and
a plurality of LED light bars vertically connected together in parallel at two ends;
wherein the exhibit grid frame is composed of a plurality of X-shaped pull rods; the pull rods are connected to each other by a plurality of plastic parts with nails; a plurality of link parts are located inside the exhibit grid frame, and each link part is fixed to two symmetrically arranged plastic parts with nails at two ends when the exhibit grid frame is open; a plurality of corner grooved plastic parts engaged with the plurality of backlit grooved straight rods are fixed to the plastic parts with nails at each corner of the exhibit grid frame; the plurality of LED light bars are suspended on a plurality of light bar hooks between an upper X-shaped pull rod and a lower X-shaped pull rod; four sides on a rear vertical plane of the exhibit grid frame are connected to each other through the corner grooved plastic parts at four corners; a display is formed by inserting silicone strips at edges of the display into corresponding grooves of the backlit grooved straight rod.

2. The backlit tension fabric popup display of claim 1, wherein each of the plurality of backlit grooved straight rod is composed of a plurality of backlit straight rods; the backlit straight rod is a right triangular straight rod; two grooves vertical with each other are provided on a non-right-angle end for either side of the right triangle except a hypotenuse; adjacent backlit straight rods are connected to each other by inserting plastic parts.

3. The backlit tension fabric popup display of claim 2, wherein the non-right angle of the right triangular straight rod, without the grooves, is 20 degrees ~70 degrees; and the non-right angle is sharp or blunt.

4. The backlit tension fabric popup display of claim 2, wherein the plurality of backlit straight rods are connected to each other in series by a string inside the plurality of backlit straight rod, in case of difficulty in locating due to dispersion.

5. The backlit tension fabric popup display of claim 2, wherein end connectors for connecting to the corner grooved plastic parts are respectively provided at both ends of the backlit grooved straight rod.

6. The backlit tension fabric popup display of claim 1, light bar hooks have a left hook and a right hook, both including a hook, an extended bar, a spring and a clamp; the clamp is a U-shaped clamp, composed of a first clamping piece, a second clamping piece and a clamping holder, a groove engaged with the LED light bars is provided between the first clamping piece and the second clamping piece; a lower end of the hook is connected to an upper end of the extended bar and the hook is rotatable on the extended bar; a lower end of the extended bar is connected to an upper end of the spring, and the extended bar is inserted into the clamping holder of the clamp by the spring; the spring is fixed within the clamping holder of the clamp by a fastener at the bottom; widths of the first clamping piece of the left hook and the second clamping piece of the left hook are both increased towards the left, while widths of the first clamping piece of the right hook and the second clamping piece of the right hook are both increased towards the right.

7. The backlit tension fabric popup display of claim 6, wherein the hook, the extended bar and the clamp are all made of plastic.

8. The backlit tension fabric popup display of claim 1, wherein intra-columns of the LED light bars are connected by engaged DC male and female connectors, and each column of the LED light bars is then connected to its own power adaptor.

9. The backlit tension fabric popup display of claim 1, wherein intra-columns of the LED light bars are connected by the engaged DC male and female connectors, and connected intra-columns of the LED light bars are then connected to a single power adaptor.

10. The backlit tension fabric popup display of claim 1, wherein each of the four sides comprises one of the plurality of backlit grooved straight rod.

11. A backlit tension fabric popup display, comprising:
an exhibit grid frame;
a plurality of backlit grooved straight rods; and
a plurality of LED light bars parallelly connected together at two ends;
wherein the exhibit grid frame is composed of a plurality of X-shaped pull rods; the pull rods are connected to each other by a plurality of plastic parts with nails; a plurality of link parts are located inside the exhibit grid frame, and each link part is fixed to two symmetrically arranged plastic parts at two ends with nails when the exhibit grid frame is open; a plurality of corner grooved plastic parts engaged with the plurality of backlit grooved straight rod are fixed to the plastic parts with nails at each corner of the exhibit grid frame; the plurality of LED light bars are suspended on a light bar hook between an upper X-shaped pull rod and a lower X-shaped pull rod; eight sides on a front vertical plane and a rear vertical plane of the exhibit grid frame are connected to each other through the corner grooved plastic parts at eight corners; a display is formed by inserting silicone strips at edges of the display into corresponding grooves of the backlit grooved straight rod.

12. The backlit tension fabric popup display of claim 11, wherein each of the plurality of backlit grooved straight rod is composed of a plurality of backlit straight rods; the backlit straight rod is a right triangular straight rod; two grooves vertical with each other are provided on a non-right-angle end for either side of the right triangle except a hypotenuse; adjacent backlit straight rods are connected to each other by inserting plastic parts.

13. The backlit tension fabric popup display of claim 12, wherein the non-right angle of the right triangular straight rod, without the grooves, is 20 degrees ~70 degrees; and the non-right angle is sharp or blunt.

14. The backlit tension fabric popup display of claim 12, wherein the plurality of backlit straight rods are connected to each other in series by a string inside the backlit straight rod, in case of difficulty in locating due to dispersion.

15. The backlit tension fabric popup display of claim 12, wherein end connectors for connecting to the corner grooved plastic parts are respectively provided at both ends of the backlit grooved straight rod.

16. The backlit tension fabric popup display of claim 11, light bar hooks have a left hook and a right hook, both including a hook, an extended bar, a spring and a clamp; the clamp is a U-shaped clamp, composed of a first clamping piece, a second clamping piece and a clamping holder; a groove engaged with the LED light bars is provided between the first clamping piece and the second clamping piece; a lower end of the hook is connected to an upper end of the extended bar and the hook is rotatable on the extended bar; a lower end of the extended bar is connected to an upper end of the spring, and the extended bar is inserted into the clamping holder of the clamp by the spring; the spring is fixed within the clamping holder of the clamp by a fastener at the bottom; widths of the first clamping piece of the left hook and the second clamping piece of the left hook are both increased towards the left, while widths of the first clamping piece of the right hook and the second clamping piece of the right hook are both increased towards the right.

17. The backlit tension fabric popup display of claim 16, wherein the hook, the extended bar and the clamp are all made of plastic.

18. The backlit tension fabric popup display of claim 11, wherein intra-columns of the LED light bars are connected by engaged DC male and female connectors, and each column of the LED light bars is then connected to its own power adaptor.

19. The backlit tension fabric popup display of claim 11, wherein intra-columns of the LED light bars are connected by the engaged DC male and female connectors, and connected intra-columns of the LED light bars are then connected to a single power adaptor.

20. The backlit tension fabric popup display of claim 11, wherein each of the eight sides comprises one of the plurality of backlit grooved straight rod.

* * * * *